United States Patent [19]

Smith

[11] Patent Number: 5,076,339

[45] Date of Patent: Dec. 31, 1991

[54] SOLID LUBRICANT FOR DIE CASTING PROCESS

[76] Inventor: John J. Smith, 7621 Partridge Meadows, Hudson, Ohio 44236

[21] Appl. No.: 476,887

[22] Filed: Feb. 8, 1990

[51] Int. Cl.[5] ..... B22D 17/10

[52] U.S. Cl. ..... 164/72; 252/10; 252/23; 252/51.5 A

[58] Field of Search ..... 164/72; 252/10, 23, 252/51.5 A

[56] References Cited

U.S. PATENT DOCUMENTS

| | | | |
|---|---|---|---|
| 2,923,041 | 2/1960 | Ryznar | 164/72 |
| 3,645,319 | 2/1972 | Pondelicek et al. | 164/72 |
| 3,779,305 | 12/1973 | Pondelicek et al. | 164/72 |
| 3,830,280 | 8/1974 | Larsen | 164/72 |
| 4,923,624 | 5/1990 | Albanesi | 252/10 |

FOREIGN PATENT DOCUMENTS

| | | | |
|---|---|---|---|
| 0850256 | 7/1981 | U.S.S.R. | 164/72 |

*Primary Examiner*—Jacqueline V. Howard

*Attorney, Agent, or Firm*—Tarolli, Sundheim & Covell

[57] ABSTRACT

The present invention resides in a die casting process using a solid lubricant composition. The lubricant composition preferably comprises (a) about 30% to about 70% by weight of a high melting point synthetic wax having a melting point in the range of about 270° F. to about 310° F. (132°-154° C.); (b) about 10 to about 50% by weight of a wax having a lower melting point in the range of about 150° F. to about 250° F. (65°-121° C.).

9 Claims, 1 Drawing Sheet

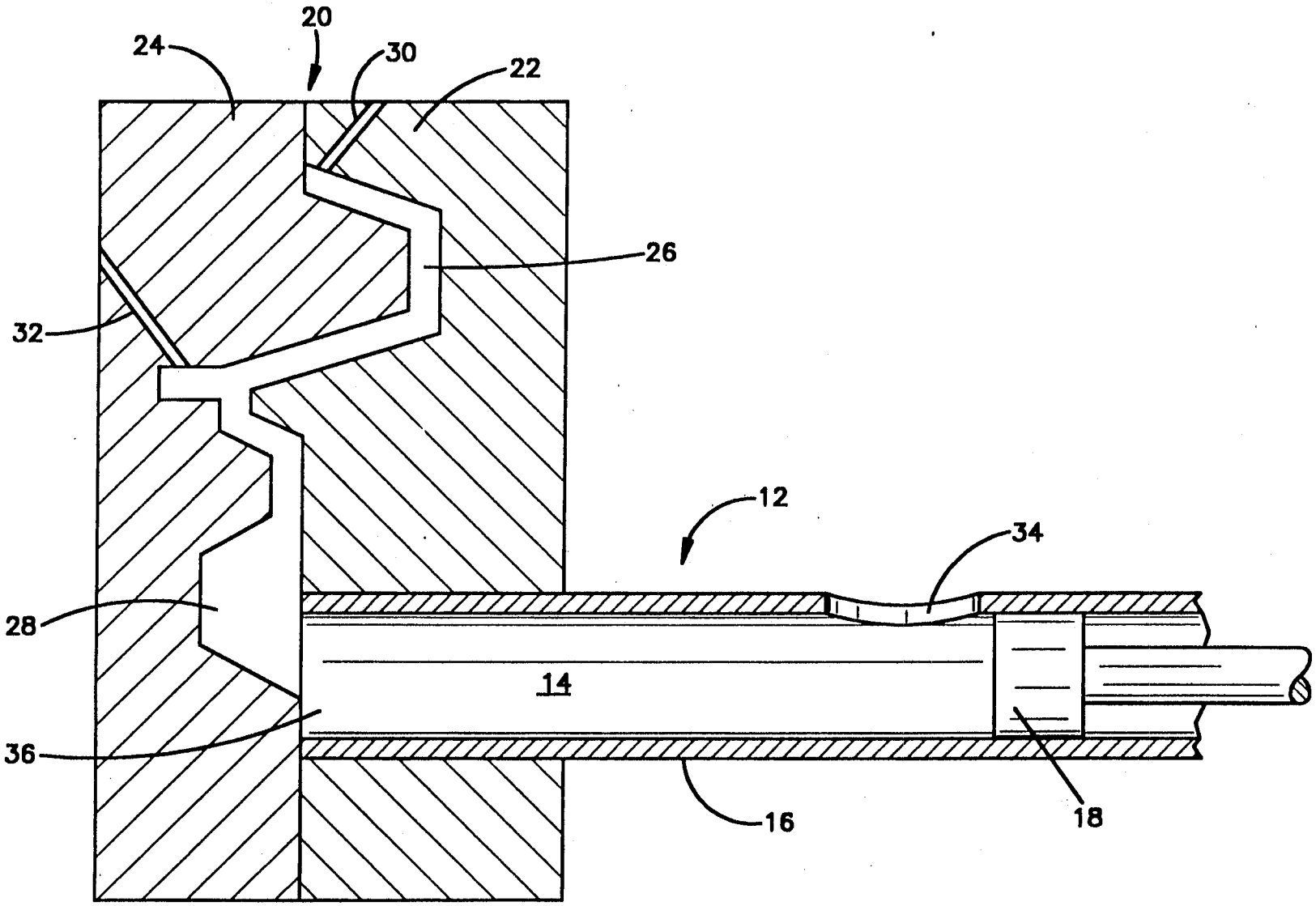
12
14
16
18
20
22
24
26
28
30
32
34
36

SOLID LUBRICANT FOR DIE CASTING PROCESS

BACKGROUND OF THE INVENTION

1. Technical Field

The present invention relates to a novel die casting process and to a solid lubricant composition useful as the plunger lubricant in die casting.

2. Description of the Prior Art

Die casting is a well known process in which molten metal is introduced into a shot chamber of a die casting machine The molten metal is then forced by the application of pressure into the die cavity of a mold. The application of pressure during casting produces stronger, more accurate and more consistent castings In what is known as a cold chamber process, the shot chamber is unheated except from the heat from the molten metal. A plunger is reversibly movable in the shot chamber, and when actuated, moves forward to exert pressure on the molten metal. A cold chamber process can require high pressures on the molten metal. This in turn requires close dimensional plunger tolerances which can create severe friction problems. Efficient lubrication is necessary to prevent metal adhering to the walls of the shot chamber and to the tip of the plunger and to minimize galling and wear of the plunger and shot chamber.

Most plunger lubricants which are in use today are oil or water-based emulsions of an active lubricating ingredient. They are liquid. The water-based emulsions can also contain other active lubricating ingredients such as synthetic or natural waxes, oils, polymers, graphite, esters, other metallic soaps, fatty acids and fatty acid soaps. These liquid plunger lubricants are typically sprayed into the shot chamber, dripped onto the plunger, or even brushed onto the plunger.

The use of the liquid lubricants creates many problems. One problem is the creation of smoke or steam when they encounter the hot surfaces in the shot chamber, which smoke or steam is an environmental and safety hazard. Another is that the liquid becomes deposited on the ceiling of the die casting plant, on crane rails and adjacent equipment, and on the outside of the die casting machine creating a deposit which must be cleaned up. Also, a substantial volume of the liquid lubricant must be used.

Solid lubricating compositions are known. U.S. Pat. No. 3,895,899 discloses the use of a solid lubricating composition for the manufacture of metallic parts by extrusion die forming. The solid lubricating composition comprises an inorganic binder resistant to elevated temperatures. The composition also contains either graphite or molybdenum disulfide, and optionally, an alkaline earth metal.

Similar lubricating compositions are marketed by E/M Lubricants, Inc. under the trademark EVERLUBE. The solid lubricating compositions can contain an organic binder such as a phenolic resin or an inorganic binder such as sodium silicate. The active lubricating ingredient in the compositions can be molybdenum disulfide with or without graphite.

Prior U.S. Pat. No. 4,210,259 discloses a solid epoxy coating, suitable for metal container end walls. The coating can contain 20–30% of a lubricating additive such as polyethylene, a synthetic wax such as ACRAWAX marketed by Glyco Chemicals, Inc., and carnauba wax. It is indicated in the patent that combinations of the lubricating additives can be used.

Prior U.S. Pat. No. 2,530,838 discloses a water-dispersible lubricating composition useful for drawing wire or metal stock. The lubricating composition comprises 10–40 parts of a synthetic wax having a melting point of at least about 95° C. (203° F.), about 35–85 parts of an inorganic boron containing compound such as a metal borate, and 5–25 parts of a water-soluble organic binder. Examples of suitable binders are polyhydric alcohols and the fatty acid esters thereof, e.g., glyceryl monostearate and diglycol stearate. The lubricating composition is dispersed in water at a temperature of at least about 90° C., and then the water dispersion is applied to a surface of wire or metal stock, for instance by dipping the wire or metal stock in the solution, and dried. The stock, containing a dry film of the lubricant can then be drawn into a desired shape.

Prior U.S. Pat. No. 4,766,166 discloses a blend of a high melting synthetic wax such as a Fischer-Tropsch wax with a polyethyelene material, useful as a lubricant during the extrusion of plastics.

SUMMARY OF THE INVENTION

The present invention resides in a die casting process which does not use a liquid lubricant but rather uses a solid lubricant. Thus the above-mentioned problems which are encountered when using liquid lubricants are minimized. Minimum creation of gas (smoke) results from use of the solid lubricant, and thus minimizes the environmental and safety hazzards of the liquid lubricants. Also, the solid lubricant material provides a minimum deposit on the ceiling of the die casting plant, on crane rails and adjacent equipment and on the outside of the die casting machine thus minimizing cleaning requirements. Further, less lubricant material by volume is required when a solid lubricant is used.

The present invention also resides in use of a solid lubricant composition as the plunger lubricant in cold chamber die casting. The lubricant composition preferably comprises (a) about 30% to about 70% of a high melting point synthetic wax having a melting point in the range of about 270° F. to about 310° F. (132°–154° C.); (b) about 10 to about 50% of a wax having a lower melting point in the range of about 110° F. to about 250° F. (43°–121° C.); and (c) about 10 to about 30 per cent of a solid fatty acid or fatty acid soap.

A preferred synthetic wax in accordance with the present invention is a bis-stearamide wax having a melting point in the range of about 280° F. to about 324° F.

The lubricant composition of the present invention can also contain up to about 20% of an inorganic lubricant. Examples of suitable inorganic lubricants are graphite and molybdenum sulfide. Also the composition of the present invention preferably contains up to about 4% of a metallic soap, more preferably up to about 4% of a phosphate ester.

BRIEF DESCRIPTION OF THE DRAWINGS

Further features of the present invention will become apparent to those skilled in the art to which the present invention relates from reading the following specification with reference to the accompanying drawing, in which:

The FIGURE is a schematic sectional view of a cold chamber die casting machine in which a solid lubricant is used according to the present invention.

DESCRIPTION OF PREFERRED EMBODIMENTS

Referring to the FIGURE, the die casting machine is a horizontal cold chamber machine. The machine 12 comprises a horizontal cylindrical pressure chamber 14 defined by shot sleeve 16. A plunger 18 is movable within the pressure chamber 14 from a retracted position, which is shown in the figure to an advanced position (not shown) close to die 20. The die 20 comprises die halves 22 and 24 which define a die cavity 26. The pressure chamber 14 is in communication with the die cavity 26 through injection passage 28. The die halves 22 and 24 are provided with narrow diameter vent holes 30, 32.

In operation, a solid-wax lubricant according to the present invention is introduced into the pressure chamber 14 through pour hole 34. This is done at the beginning of each operating cycle, while the plunger 18 is in its retracted position as shown in the FIGURE. The solid wax lubricant can be introduced either manually, or automatically from a dispensing apparatus. The solid lubricant can be in any form convenient for use. For instance, it may be in particulate form, for instance, as pellets or beads, or in slab or stick form. The desired amount of molten metal is then introduced into the pressure chamber 14 through the pour hole 34. The plunger 18 is then advanced forward in the direction of the die 20 until it blocks the pour hole 34. It is then further advanced a predetermined distance injecting the molten metal through the injection passage 28 into the die cavity 26. After a pre-set dwell time, which permits the molten metal to solidify, the die 20 is opened and the plunger 18 is then further advanced to complete a full stroke in which the casting is released from the stationary half 22 of the die. This also forces the residual, solidified plug from the forward end 36 of the pressure chamber 14. The plunger 18 is then retracted to a starting position and the casting is ejected from the movable half 24 of the die. The machine is then ready for another cycle.

Metals usually cast in cold chamber machines are aluminum, magnesium and copper alloys, for instance brass. These metal alloys are superheated, for instance to temperatures in the range of about 1250° F. to about 1550° F. before being introduced into the shot sleeve 16. Injection pressures can range from 8,000 psi up to 40,000 psi and higher. The plunger speed normally is from about 150 to about 900 feet per minute. Frictional forces become extremely high in the final stage of plunger travel, and the resulting wear of the plunger and sleeve is related to the combined effect of heat, pressure generated during the shot cycle, and plunger speed. Most plunger tips and shot chambers are made of heat and wear resistant materials. Despite this, it is necessary to rely on plunger lubricants which are capable of reducing frictional and shear forces under the high temperature and high speed conditions encountered in die casting. Another function of the lubricant is to minimize erosion or wash out of the shot sleeve 16 beneath the pour hole 34 due to the impact of the molten metal on the shot sleeve when the molten metal is introduced through the pour hole. The lubricant also and very importantly must keep the metal from sticking (soldering) to the shot sleeve.

The solid lubricant may be of any suitable composition. Preferably, a wax-base lubricating composition is used including a high melting point wax which has a melting point in the range of about 270° F. to about 310° F. (132°-154° C.). Preferably, the high melting point wax has a flash point of at least about 500° F. (about 260° C.) so that it does not flash off during the initial stages of contact of the lubricant with the components of the die casting machine, for instance the shot sleeve 16. These components, because of the residual heat in the die casting machine, may be at a high temperature, for instance, about 500° F.

A preferred high melting point wax is a bis-stearamide wax marketed by Lonza Incorporated under the trademark ACRAWAX C. Broadly this wax is a member of a class of complex nitrogen derivatives of higher fatty acids, more particularly, a higher fatty acid amide. It is chemically defined as N, N' ethylene bis stearamide or N, N' distearoyl ethylene diamine. ACRAWAX C has a melting point of about 284° to 293° F. (140°-145° C.), a flash point of about 546° F. (285° C.) and an acid value of 8 maximum. ACRAWAX C has been marketed as a plasticizer for resins and as a lubricant in molding processes.

An example of another synthetic high melting point wax useful in the compositions of the present invention is one marketed by Frank B. Ross Co., Inc. under the trademark ROSS WAX 140. ROSS WAX 140 has a melting point of about 280° F. to about 284° F. (138°-140° C.) and a flash point of more than about 530° F. Another high melting point synthetic wax is ROSS WAX 160 which has a melting point of about 314° to about 324° F. (157°-162° C.) and a flash point of 590° F. They have been marketed as a processing aid for wire drawing compounds, and as a mold release lubricant for powdered metal products. Another example of a high melting point wax that can be used is a montan ester wax. Such montan ester wax is marketed by Hoechst Corporation under the designation Hoechst Wax KSL.

The primary function of the high melting point wax is to prevent metal from sticking to the shot sleeve 16. Preferably, the high melting point wax is employed in an amount of about 30-70% by weight based on the weight of the lubricating composition.

The second ingredient of the lubricating composition of the present invention is a lower melting point wax having a melting point in the range of about 110° F. to about 250° F. (43°-121° C.). Examples of suitable lower melting point waxes are set forth in the following Table 1:

TABLE 1

| WAX | MANUFACTURER AND/OR TRADEMARK | MELTING POINT | FLASH POINT | ACID NO. |
|---|---|---|---|---|
| Microcrystalline Wax | Frank B. Ross Co., Inc. | 140-205° F. (60-96.5° C.) | 500° F. min. | Nil |
| Carnauba | " | 181.4-187° F. (83-86° C.) | 570° F. min. | 2-10 |
| Paraffin Wax | " | 112-165° F. (44.5-74° C.) | 380° F. min | Nil |
| Polyethylene Wax | "Allied 629" Allied Chemical Corp. | 214° C. (100° C.) | — | — |

TABLE 1-continued

| WAX | MANUFACTURER AND/OR TRADEMARK | MELTING POINT | FLASH POINT | ACID NO. |
|---|---|---|---|---|
| Beeswax | Natural | 140° F.-150° F. (60-66° C.) | — | — |

It has been found the lower melting point wax minimizes the solidification of the lubricant in the vent holes 30 and 32 of the machine die halves 22, 24. Such vent holes characteristically are very small in diameter, and if plugged, can interrupt satisfactory operation of the die casting machine. Subsequent to a die forming cycle, the die halves may be at a temperature of 500° F. The lower melting point wax minimizes the condensation of wax vapors which might otherwise occur on surfaces at this temperature.

The low melting point wax preferably is present in lubricating composition. The weight ratio of high melting point wax to lower melting point wax is preferably in the range of about 1:1 to about 4:1. The solid lubricant of the present invention is thus, preferably, at least 40% wax.

A third ingredient of the lubricating composition is 0 to about 20% by weight, based on the weight of the total composition, of an inorganic lubricant solid. Preferably the lubricating composition of the present invention comprises at least about 2% by weight of an inorganic lubricant solid. In the selection of inorganic solid lubricants, graphite, because of its lamellar form, has a low coefficient of friction and is preferred. Molybdenum disulfide is a common frequently used solid inorganic lubricant and can also be used. Other solid inorganic lubricants include other disulfides and diselenides of metals that occur in the second and third rows of the periodic table and have layered crystal structures, such as molybdenum diselenide and niobium disulfide. Fluorides of alkaline metal and alkaline earth metals such as calcium difluoride have good cleavage planes and good lubricating properties. The function of the solid inorganic lubricant is to provide metal-to-metal lubrication, for instance between the shot sleeve 16 and plunger 18, and, a thermal shock barrier between the molten metal and the shot sleeve 16.

A fourth ingredient of the composition of the present invention is 0 to about 30% by weight, based on the weight of the total composition, of a solid fatty acid or fatty acid soap such as stearic acid, palmitic acid, sodium stearate or sodium palmitate. Preferably the composition of the present invention contains about 10% to about 30% by weight fatty acid or fatty acid soap. A purpose of the fatty acid or fatty acid soap is to provide a cleaner burn with less smoke. The fatty acid or fatty acid soap also functions as a lubricant.

A fifth ingredient in the lubricating composition of the present invention is 0 to about 4% by weight, based on the weight of the total composition, of a metal acid ester such as a phosphate ester. One suitable phosphate ester is marketed by The Southland Corporation under the trademark ACTRAFOS 110-A. This compound is characterized as an alcohol polyethyleneoxy phosphate ester acid. It has been used as an additive in cutting fluids, drawing compounds, greases and other uses. Its function in the composition of the present invention is to provide lubricity in extreme pressure conditions.

The following examples illustrate the present invention.

EXAMPLES 1-3

In the following Examples, the compositions of the lubricant were prepared by melting the high melting point wax and then blending the other ingredients of the composition into the molten wax in the proportions indicated. The composition blends were then allowed to solidify in the form of pellets. In all of the examples, the high melting point wax was a bis-stearamide wax marketed under the trademark ACRAWAX C. The lower melting point waxes used were:

| | |
|---|---|
| Example 1 | Polyethylene Wax 629, Allied Chemical Corp. |
| Example 2 | Microcrystalline Wax, m.p. 140-205° F. marketed by Frank B. Ross, Inc. |
| Example 3 | Microcrystalline Wax, m.p. 140-205° F., marketed by Frank B. Ross, Inc. |

The compositions of Examples 1, 2 and 3, contained the following weight proportions and ingredients:

TABLE 2

| EXAMPLE | HIGH M.P. WAX % | LOW M.P. WAX % | STEARIC ACID % | GRAPHITE % | PHOSPHATE ESTER % |
|---|---|---|---|---|---|
| 1 | 44 | 30 | 20 | 4 | 2 |
| 2 | 60 | 16 | 20 | 4 | — |
| 3 | 50 | 46 | — | 4 | — |

The compositions of all of the Examples exhibited excellent lubricity during use, meeting criteria established for the compositions of the present invention. All reduced metal-to-metal friction and wear between the plunger 18 and shot sleeve 16. All reduced wash-out of the shot sleeve 16, below the pour hole 34, and the condensation of vapors in the die vent holes 30, 32. All prevented the molten metal from sticking to the shot sleeve. The compositions of the present invention reduced smoke generation, possibility of explosion, and possibility of fire. Further, the amount of the solid lubricant used by volume was approximately 1/6 the volume required when an oil or water-based liquid lubricant is used.

From the above description of preferred embodiments of the invention, those skilled in the art will perceive improvements, changes and modifications. Such improvements, changes and modifications are intended to be covered by the appended claims.

Having described the specific preferred embodiments of the invention, I claim:

1. A die casting method comprising the steps of placing a solid plunger lubricant into a chamber of a shot sleeve of a die casting machine, said chamber having a high temperature from prior operation of said machine, said lubricant melting upon contact with the shot sleeve;

pouring molten metal into the chamber of said shot sleeve, and forcing the molten metal and the molten lubricant into a die cavity by movement of a plunger through the chamber of said shot sleeve, said solid plunger lubricant being at least 40% wax having a melting point below the temperature of said chamber.

2. A method as defined in claim 1 wherein the solid plunger lubricant comprises:

(a) about 30–70% by weight of a high melting point synthetic wax having a melting point in the range of about 270° F. to about 310° F. (132°–154° C.);

(b) about 10 to about 50% by weight of a wax having a melting point in the range of about 110° F. to about 250° F. (43°–121° C.);

(c) the weight ratio of (a) to (b) being in the range of about 1:1 to about 4:1.

3. The method of claim 2 wherein said hiehg melting point wax has a flash point of at least about 500° F. (260° C.).

4. The method of claim 3 wherein said high melting point wax is a bis-stearamide.

5. The method of claim 4 wherein said composition further comprises about 10% to about 30% by weight of a solid fatty acid or fatty acid soap, about 2% to about 20% by weight of a solid inorganic lubricant, and about 1% to about 4% by weight of a phosphate ester.

6. A die casting method comprising the steps of pouring molten metal into a chamber of a shot sleeve of a die casting machine, said chamber having a high temperature from prior operation of said machine;

forcing the molten metal into a die cavity of the die casting machine by movement of a plunger through the chamber of the shot sleeve;

exhausitn gases from the die cavity as the molten metal is forced into the die cavity;

prior to pouring molten metal into the chamber of the shot sleeve placing individual pieces of a solid plunger lubricant in the chamber of the shot sleeve, said solid plunger lubricant being at least 40% wax having a melting point below the temperature of said chamber;

melting said individual pieces of solid plunger lubricant in the chamber of the shot sleeve to create a lubricant coating on surface portions of the shot sleeve;

forcing some of the lubricant coating into the die cavity by movement of the plunger in the chamber of the shot sleeve and by movement of the molten metal into the die cavity; and exhausting gases created in the melting of the solid lubricant from the die cavity.

7. A die casting method as defined in claim 6 wherein said die cavity has vent passage means and said exhausting steps comprise the steps of allowing gases to flow through said vent passage means, and the method further including the step of minimizing the possibility of the vent passage means becoming blocked by making said solid lubricant of a high melting point wax and a lower melting point wax.

8. The method of claim 6 wherein said solid plunger lubricant is in a particulate form.

9. The method of claim 6 wherein said solid plunger lubricant is in a slab or stick form.

* * * * *

UNITED STATES PATENT AND TRADEMARK OFFICE

CERTIFICATE OF CORRECTION

PATENT NO. : 5,076,339

DATED : December 31, 1991

INVENTOR(S) : John J. Smith

It is certified that error appears in the above-identified patent and that said Letters Patent is hereby corrected as shown below:

Column 7, Line 23, Claim 3, change "hiehg" to --high--.

Column 8, Line 6, Claim 6, change " exhaustin" to --exhausting--.

Signed and Sealed this

Twentieth Day of April, 1993

*Attest:*

MICHAEL K. KIRK

*Attesting Officer*

*Acting Commissioner of Patents and Trademarks*

US005076339B1

REEXAMINATION CERTIFICATE (3538th)

United States Patent [19]

Smith

[11] B1 5,076,339

[45] Certificate Issued Jun. 9, 1998

[54] SOLID LUBRICANT FOR DIE-CASTING PROCESS

[75] Inventor: John J. Smith, Hudson, Ohio

[73] Assignee: J&S Chemical Corporation, Twinsburg, Ohio

Reexamination Requests:
No. 90/004,736, Aug. 12, 1997
No. 90/004,751, Sep. 17, 1997

Reexamination Certificate for:

| | |
|---|---|
| Patent No.: | **5,076,339** |
| Issued: | **Dec. 31, 1991** |
| Appl. No.: | **476,887** |
| Filed: | **Feb. 8, 1990** |

Certificate of Correction issued Apr. 20, 1993.

[51] Int. Cl.[6] ..... B22D 17/10

[52] U.S. Cl. ..... 164/72; 164/113; 508/113; 508/120; 508/167; 508/174; 508/554; 508/579; 508/580

[58] Field of Search ..... 164/72, 113; 508/113, 508/120, 167, 174, 554, 579, 580

[56] References Cited

U.S. PATENT DOCUMENTS

| | | | |
|---|---|---|---|
| 1,948,194 | 2/1934 | Williams | 205/21 |
| 2,265,491 | 1/1941 | Young | 106/270 |
| 2,923,041 | 2/1960 | Ryznar | 164/72 |
| 3,645,319 | 2/1972 | Pondelicek et al. | 164/72 |
| 3,779,305 | 12/1973 | Pondelicek et al. | 164/72 |
| 3,830,280 | 8/1974 | Larsen | 164/72 |
| 4,923,624 | 5/1990 | Albanesi | 252/10 |
| 5,014,765 | 5/1991 | Aoyama et al. | 164/72 |

FOREIGN PATENT DOCUMENTS

| | | | |
|---|---|---|---|
| 0150989 | of 1962 | U.S.S.R. . | |
| 0850256 | 7/1981 | U.S.S.R. | 164/72 |
| 0984658 | 1/1983 | U.S.S.R. | 164/267 |

OTHER PUBLICATIONS

"Hackh's Chemical Dictionary" by Julius Grant, p. 722, McGraw-Hill, 1969.

Allied Signal Specification Sheet A–C, Polyethylene, 1986.

The Condensed Chemical Dictionary, 7th Ed. 1966, p. 759.

Lubricants for Casting Under Pressure, 1983, Zelenov et al. and translation pp. 104–106 and Table 2.1, Item 27, p. 21.

*Primary Examiner*—K. Y. Lin

[57] ABSTRACT

The present invention resides in a die casting process using a solid lubricant composition. The lubricant composition preferably comprises (a) about 30% to about 70% by weight of a high melting point synthetic wax having a melting point in the range of about 270° F. to about 310° F. (132°–154° C.); (b) about 10 to about 50% by weight of a wax having a lower melting point in the range of about 150° F. to about 250° F. (65°–121° C.).

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–9 is confirmed.

New claims 10–28 are added and determined to be patentable.

*10. The die casting method as claimed in claim 1, wherein the solid plunger lubricant is in a particulate form.*

*11. The die casting method as claimed in claim 10, wherein the particulate form is beads or pellets.*

*12. The die casting method of claim 1, wherein the solid plunger lubricant is placed into the chamber of the shot sleeve through the pour hole by means of an automatic dispensing apparatus.*

*13. The die casting method of claim 1, wherein the wax comprises at least one wax selected from the group consisting of a montan wax, a carnauba wax, an ethylene bis-stearamide wax, and a polyethylene wax.*

*14. The die casting method of claim 1, wherein the solid plunger lubricant further comprises at least one inorganic lubricant.*

*15. The die casting method of claim 14, wherein the inorganic lubricant is selected from the group consisting of graphite, a metal disulfide, and a metal diselenide.*

*16. The die casting method of claim 1, wherein the solid plunger lubricant further comprises at least one fatty acid or a fatty acid soap.*

*17. The die casting method of claim 1, wherein the solid plunger lubricant further comprises at least one metallic soap.*

*18. The die casting method of claim 1, wherein the wax comprises a montan ester wax.*

*19. The die casting method of claim 1, wherein the solid plunger lubricant further comprises a stearate soap or a palmitate soap.*

*20. The die casting method of claim 8, wherein the particulate form is beads or pellets.*

*21. The die casting method of claim 6, wherein the solid plunger lubricant is placed into the chamber of the shot sleeve through the pour hole by means of an automatic dispensing apparatus.*

*22. The die casting method of claim 6, wherein the wax comprises at least one wax selected from the group consisting of a montan wax, a carnauba wax, an ethylene bis-stearamide wax, and a polyethylene wax.*

*23. The die casting method of claim 6, wherein the solid plunger lubricant further comprises at least one inorganic lubricant.*

*24. The die casting method of claim 23, wherein the inorganic lubricant is selected from the group consisting of graphite, a metal disulfide, and a metal diselenide.*

*25.The die casting method of claim 6, wherein the solid plunger lubricant further comprises at least one fatty acid or a fatty acid soap.*

*26. The die casting method of claim 6, wherein the solid plunger lubricant further comprises at least one metallic soap.*

*27. The die casting method of claim 6, wherein the wax comprises a montan ester wax.*

*28. The die casting method of claim 6, wherein the solid plunger lubricant further comprises a stearate soap or a palmitate soap.*

* * * * *